US011095049B2

(12) United States Patent
Kato et al.

(10) Patent No.: US 11,095,049 B2
(45) Date of Patent: Aug. 17, 2021

(54) ALUMINUM ELECTRIC WIRE CRIMPING TERMINAL, CRIMPING DEVICE AND CRIMPING METHOD

(71) Applicant: Yazaki Corporation, Tokyo (JP)

(72) Inventors: Sanae Kato, Shizuoka (JP); Shinya Warashina, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/519,842

(22) Filed: Jul. 23, 2019

(65) Prior Publication Data

US 2020/0036106 A1 Jan. 30, 2020

(30) Foreign Application Priority Data

Jul. 25, 2018 (JP) ..... JP2018-139619

(51) Int. Cl.

| | |
|---|---|
| ***H01R 4/10*** | (2006.01) |
| ***H01R 4/18*** | (2006.01) |
| ***H01R 4/20*** | (2006.01) |
| ***H01R 11/12*** | (2006.01) |
| ***H01R 43/058*** | (2006.01) |
| ***H01R 43/048*** | (2006.01) |
| ***H01R 4/62*** | (2006.01) |

(52) U.S. Cl.

CPC ..... *H01R 4/183* (2013.01); *H01R 4/20* (2013.01); *H01R 4/62* (2013.01); *H01R 11/12* (2013.01); *H01R 43/0484* (2013.01); *H01R 43/058* (2013.01)

(58) Field of Classification Search

CPC . H01R 4/183; H01R 4/20; H01R 4/62; H01R 11/12; H01R 43/0494; H01R 43/059

USPC ..... 439/877, 492

See application file for complete search history.

(56) References Cited

U.S. PATENT DOCUMENTS

| | | | | |
|---|---|---|---|---|
| 2,735,997 | A * | 2/1956 | Peterson | H01R 43/058 439/882 |
| 4,890,384 | A * | 1/1990 | Shaffer | H01R 43/058 29/863 |
| 5,532,433 | A * | 7/1996 | Endo | H01R 4/20 174/77 R |
| 6,568,075 | B1 * | 5/2003 | Yamakawa | H01R 43/058 29/33 M |
| 8,974,258 | B2 * | 3/2015 | Mitose | H01R 4/70 439/877 |
| 9,525,215 | B2 * | 12/2016 | Kawamura | H01R 43/048 |
| 9,640,877 | B2 * | 5/2017 | Aoki | H01R 4/62 |
| 9,755,327 | B2 * | 9/2017 | Aoki | H01R 13/5216 |
| 9,855,623 | B2 * | 1/2018 | Regenberg | B23K 20/106 |

(Continued)

FOREIGN PATENT DOCUMENTS

| | | | |
|---|---|---|---|
| JP | 2005327690 | A | 11/2005 |
| JP | 2009-176571 | A | 8/2009 |

*Primary Examiner* — Harshad C Patel

(74) *Attorney, Agent, or Firm* — Sughrue Mion, PLLC

(57) ABSTRACT

An aluminum electric wire crimping terminal formed by connecting an aluminum electric wire and a crimping terminal includes a low compression concave portion and a high compression concave portion in a crimping portion. The high compression concave portion compresses a plurality of core wires with a stronger compression force than a compression force of the low compression concave portion.

2 Claims, 9 Drawing Sheets

(56) References Cited

U.S. PATENT DOCUMENTS

| | | | | |
|---|---|---|---|---|
| 9,941,601 | B2 * | 4/2018 | Kawamura | H01R 13/187 |
| 2002/0119694 | A1 * | 8/2002 | Watanabe | H01R 4/2412<br>439/425 |
| 2009/0191771 | A1 | 7/2009 | Watanabe | |
| 2011/0062218 | A1 * | 3/2011 | Ohnuma | B23K 20/106<br>228/110.1 |
| 2013/0045644 | A1 * | 2/2013 | Aoki | H01R 4/183<br>439/878 |
| 2013/0095708 | A1 * | 4/2013 | Mitose | H01R 43/005<br>439/878 |
| 2014/0311798 | A1 * | 10/2014 | Numata | H01R 4/187<br>174/75 R |
| 2015/0064991 | A1 * | 3/2015 | Kawamura | H01R 4/029<br>439/879 |
| 2015/0364833 | A1 * | 12/2015 | Tonoike | H01R 4/183<br>439/879 |
| 2018/0076532 | A1 * | 3/2018 | Iwasawa | H01R 4/70 |
| 2018/0261931 | A1 * | 9/2018 | Iwata | H01R 4/184 |
| 2019/0165532 | A1 * | 5/2019 | Sato | H01R 43/0207 |

* cited by examiner

ALUMINUM ELECTRIC WIRE CRIMPING TERMINAL, CRIMPING DEVICE AND CRIMPING METHOD

CROSS-REFERENCE TO RELATED APPLICATION(S)

The present application claims priority to and incorporates by reference the entire contents of Japanese Patent Application No. 2018-139619 filed in Japan on Jul. 25, 2018.

BACKGROUND OF THE INVENTION

1. Field of the Invention

The present invention relates to an aluminum electric wire crimping terminal which is formed by connecting an aluminum electric wire and a crimping terminal, a crimping device and a crimping method.

2. Description of the Related Art

Conventionally, there is a known aluminum electric wire crimping terminalformed by connecting an aluminum electric wire and a crimping terminal. The aluminum electric wire includes a plurality of core wires which is molded by an aluminum or an aluminum alloy which is a conductive metal material, and a sheath which covers a plurality of core wires and is molded by an insulation resin material. A crimping terminal includes a contact portion and a crimping portion of a cylindrical shape. A plurality of core wires is inserted in an insertion hole of the crimping portion of the cylindrical shape, and is compressed by a crimping device or a crimping tool, so that the aluminum electric wire and the crimping terminal are mechanically connected and electrically connected. Since the core wires are molded by the aluminum or the aluminum alloy, an oxide film is formed on core wire surfaces and an oxide film is interposed between the aluminum electric wire and the crimping terminal. Therefore, a resistance during electrical connection of the aluminum electric wire and the crimping terminal becomes high.

Japanese Patent Application Laid-open No. 2009-176571 discloses a technique of connecting an aluminum electric wire and a crimping terminal including a crimping portion of a cylindrical shape. Conductors (core wires) of the aluminum electric wire are twisted and inserted in an insertion hole of the crimping portion, and a protrusion portion disposed in a spiral shape on an inner bottom surface of the insertion hole, and the conductors come into contact, so that oxide films are removed. When the crimping terminal and the aluminum electric wire are connected, the oxide films are removed to reduce the resistance and improve reliability of electrical connection.

It is demanded to improve reliability of electrical connection of an aluminum electric wire crimping terminal formed by connecting an aluminum electric wire and a crimping terminal.

SUMMARY OF THE INVENTION

The present invention has been made in light of the above. An object of the present invention is to provide an aluminum electric wire crimping terminal, a crimping device and a crimping method which can improve reliability of electrical connection for connecting an aluminum electric wire and a crimping terminal.

An aluminum electric wire crimping terminal according to one aspect of the present invention includes an aluminum electric wire; and a crimping terminal which is connected with the aluminum electric wire, wherein the aluminum electric wire includes a plurality of core wires, and a sheath which covers the plurality of core wires, the crimping terminal includes a contact portion and a crimping portion of a cylindrical shape, the crimping portion includes an insertion hole, and in a state where the plurality of core wires is inserted in the insertion hole, the crimping portion is compressed and the plurality of core wires and the crimping portion are connected, a low compression concave portion which compresses the plurality of core wires and a high compression concave portion which compresses the plurality of core wires are molded in the crimping portion, and the high compression concave portion further protrudes in a lower direction more than a distal end surface of the low compression concave portion, and compresses the plurality of core wires with a stronger compression force than a compression force of the low compression concave portion.

According to another aspect of the present invention, in the aluminum electric wire crimping terminal, the high compression concave portion may be located and molded on a side in a forward direction of the low compression concave portion.

In a crimping device which manufactures an aluminum electric wire crimping terminal according to still another aspect of the present invention, an aluminum electric wire includes a plurality of core wires, and a sheath which covers the plurality of core wires, a crimping terminal includes a connection portion and a crimping portion of a cylindrical shape, the crimping portion includes an insertion hole, the crimping device comprises a lower mold and an upper mold, the lower mold includes a mounting portion which is located on a side in an upper direction, the upper mold includes a low compression convex portion and a high compression convex portion which are integrally molded, and protrude in a lower direction, the high compression convex portion further protrudes in the lower direction more than a flat surface in the lower direction of the low compression convex portion, and when the upper mold lowers toward the lower mold located in the lower direction in a state where the plurality of core wires is inserted in the insertion hole, the low compression convex portion compresses the crimping portion and the plurality of core wires, and the high compression convex portion more strongly compresses the crimping portion and the plurality of core wires than the compression of the crimping portion and the plurality of core wires by the low compression convex portion, and a low compression concave portion and a high compression concave portion are molded in the crimping portion.

In a crimping method for connecting a crimping terminal and an aluminum electric wire of an aluminum electric wire crimping terminal according to still another aspect of the present invention, the aluminum electric wire includes a plurality of core wires, and a sheath which covers the plurality of core wires, the crimping terminal includes a connection portion and a crimping portion of a cylindrical shape, the crimping portion includes an insertion hole, a crimping device includes a lower mold and an upper mold, the lower mold includes a mounting portion which is located on a side in an upper direction, the upper mold includes a low compression convex portion and a high compression convex portion which are integrally molded, and protrude in a lower direction, the high compression convex portion further protrudes in the lower direction more than a flat surface in the lower direction of the low compression convex portion, the crimping method comprises a step of inserting the plurality of core wires in the insertion hole, a step of placing the crimping portion on the mounting portion, and a step of lowering the upper mold in a lower direction, and in the step of lowering the upper mold in a lower direction, and the low compression convex portion compresses the crimping portion and the plurality of core wires, and the high compression convex portion more strongly compresses the crimping portion and the plurality of core wires than the compression of the crimping portion and the plurality of core wires by the low compression convex portion, and a low compression concave portion and a high compression concave portion are molded in the crimping portion.

In a crimping device which manufactures an aluminum electric wire crimping terminal according to still another aspect of the present invention, an aluminum electric wire includes a plurality of core wires, and a sheath which covers the plurality of core wires, a crimping terminal includes a connection portion and a crimping portion of a cylindrical shape, the crimping portion includes an insertion hole, the crimping device includes a lower mold, a first upper mold and a second upper mold, the lower mold includes a mounting portion which is located on a side in an upper direction, the first upper mold includes a low compression convex portion which is integrally molded, and protrudes in a lower direction, the second upper mold includes a high compression convex portion which is integrally molded, and protrudes in the lower direction, when the first upper mold lowers in the lower direction facing the lower mold in a state where the plurality of core wires is inserted in the insertion hole, the low compression convex portion compresses the crimping portion and the plurality of core wires, and a low compression concave portion is molded in the crimping portion, and when the second upper mold lowers in the lower direction facing the lower mold in a state where the first upper mold lowers in the lower direction, the high compression convex portion more strongly compresses part of the low compression concave portion and the core wires than the compression of the crimping portion and the plurality of core wires by the low compression convex portion, and a high compression concave portion is molded in the low compression concave portion.

In a crimping method for connecting an aluminum electric wire and a crimping terminal of an aluminum electric wire crimping terminal according to still another aspect of the present invention, the crimping terminal includes a connection portion and a crimping portion of a cylindrical shape, the crimping portion includes an insertion hole, the aluminum electric wire includes a plurality of core wires, and a sheath which covers the plurality of core wires, a crimping device includes a lower mold, a first upper mold and a second upper mold, the lower mold includes a mounting portion located on a side in an upper direction, the first upper mold includes a low compression convex portion which is integrally molded, and protrudes in a lower direction, the second upper mold includes a high compression convex portion which is integrally molded, and protrudes in the lower direction, the crimping method comprises a step of inserting the plurality of core wires in the insertion hole, a step of placing the crimping portion on the mounting portion, a step of lowering the first upper mold in a lower direction, and a step of lowering the second upper mold in the lower direction, in the step of lowering the first upper mold in the lower direction, the low compression convex portion of the first upper mold compresses the crimping portion and the plurality of core wires, and a low compression concave portion is molded in the crimping portion, and in the step of lowering the second upper mold in the lower direction, the high compression convex portion of the second upper mold more strongly compresses part of the low compression concave portion and the core wires than the compression of the crimping portion and the plurality of core wires by the low compression convex portion, and a high compression concave portion is molded in the low compression concave portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
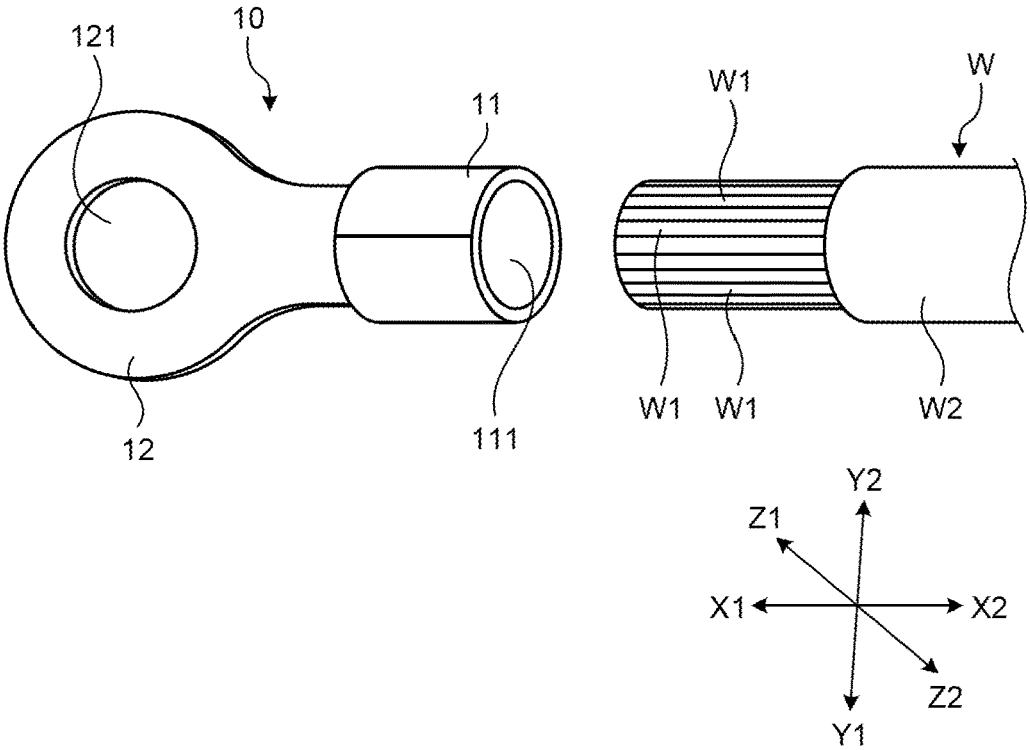
FIG. 1 is a perspective view illustrating an aluminum electric wire and a crimping terminal according to a first embodiment.

Embodiments of an aluminum electric wire crimping terminal which is formed by connecting an aluminum electric wire and a crimping terminal, a crimping device and a crimping method according to the present invention will be described in detail below based on the drawings. In addition, these embodiments do not limit the present invention. In the drawings, X indicates forward and backward directions, X1 indicates a forward direction, and X2 indicates a backward direction. Y indicates a width direction, Y1 indicates a left direction, and Y2 indicates a right direction. Z indicates a height direction, Z1 indicates an upper direction, and Z2 indicates a lower direction. In this regard, X, Y and Z are directions perpendicular to each other.

First Embodiment

Figure 2:
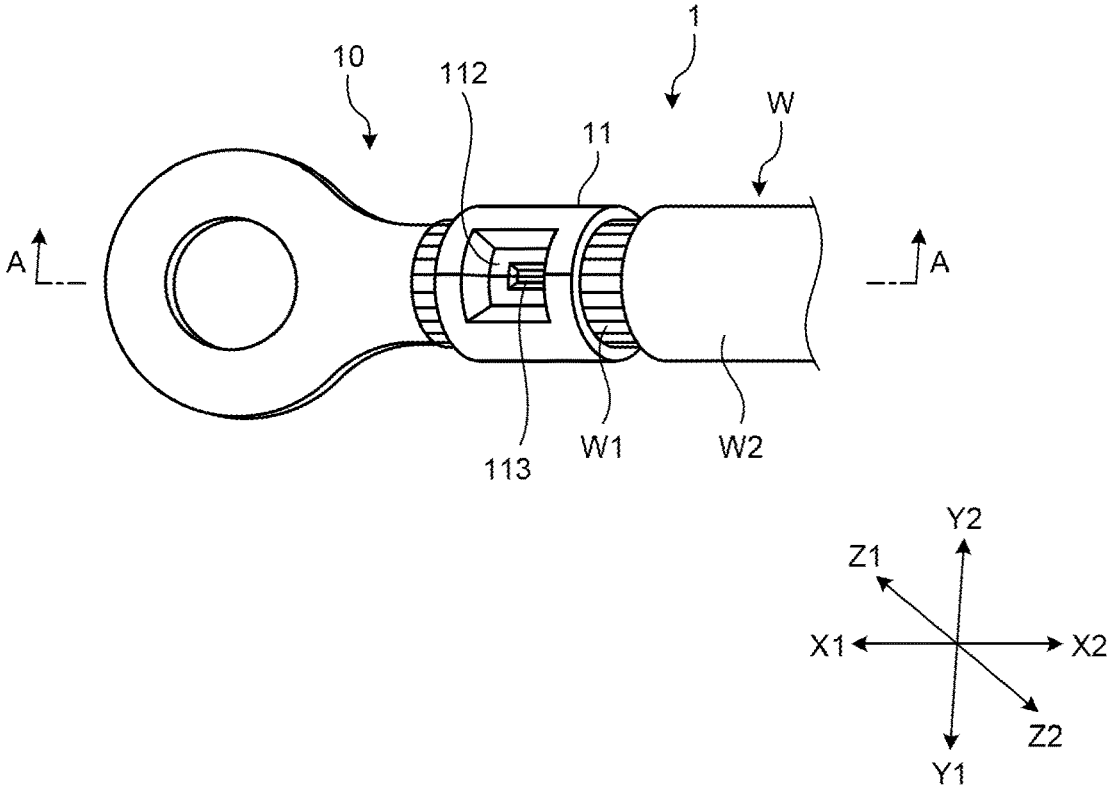
FIG. 2 is a perspective view illustrating an aluminum electric wire crimping terminal according to the first embodiment.
Figure 3:
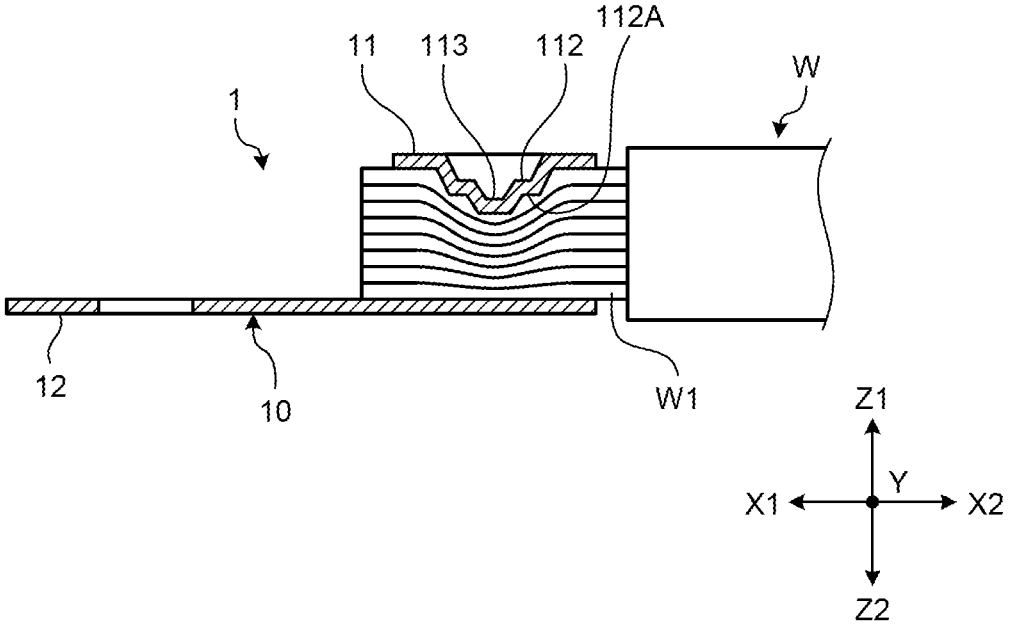
FIG. 3 is a cross-sectional view of the aluminum electric wire crimping terminal according to the first embodiment seen from A-A in FIG. 2.
Figure 4:
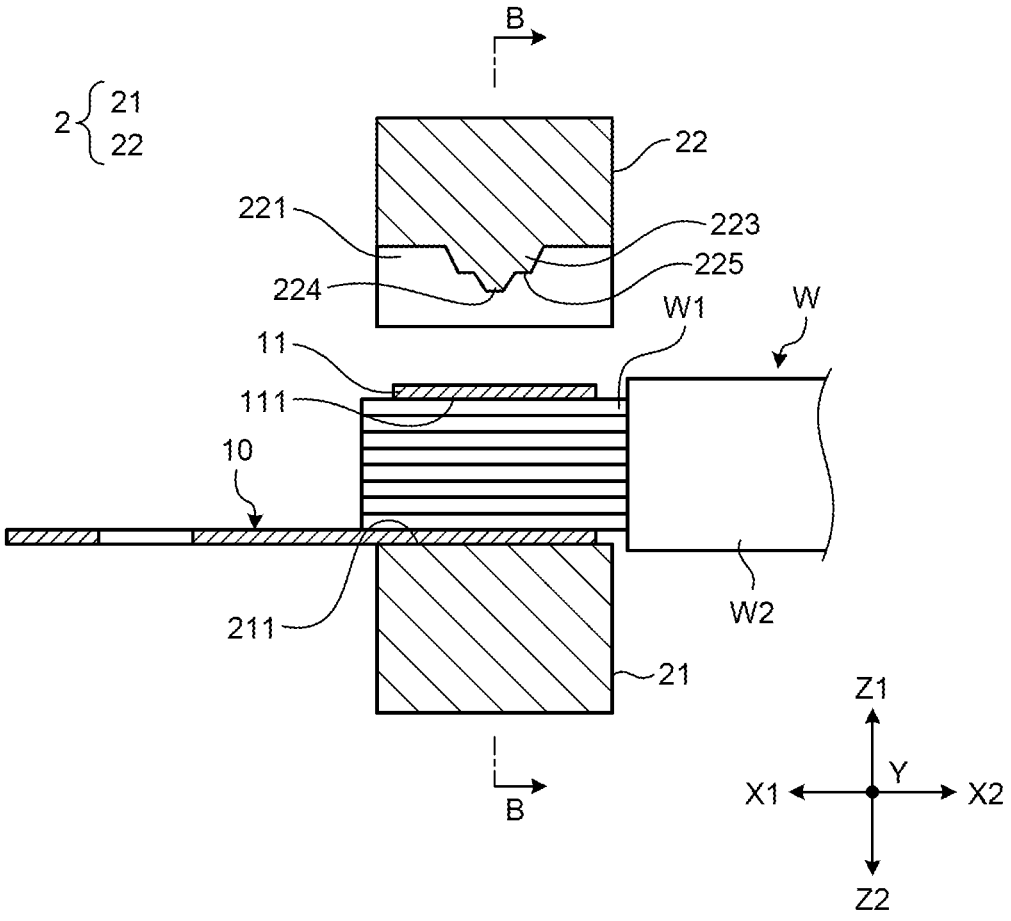
FIG. 4 is a cross-sectional view illustrating that the aluminum electric wire and the crimping terminal according to the first embodiment are connected by a crimping device.
Figure 5:
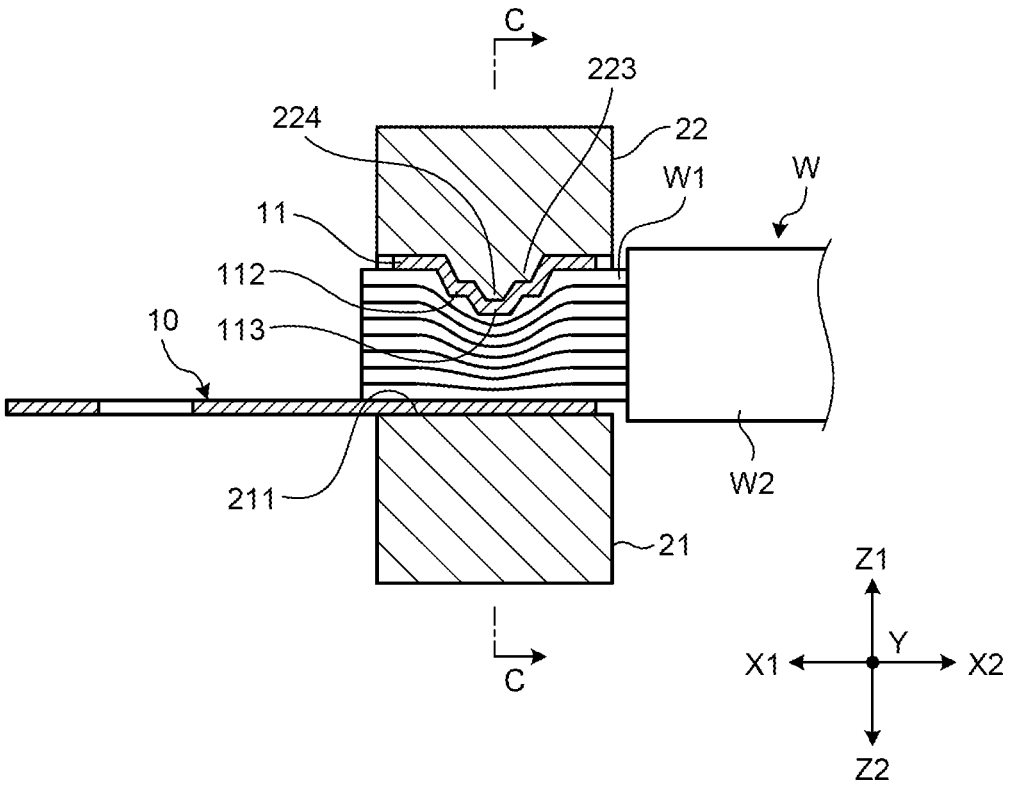
FIG. 5 is a cross-sectional view illustrating that the aluminum electric wire and the crimping terminal according to the first embodiment are connected by the crimping device.
Figure 6:
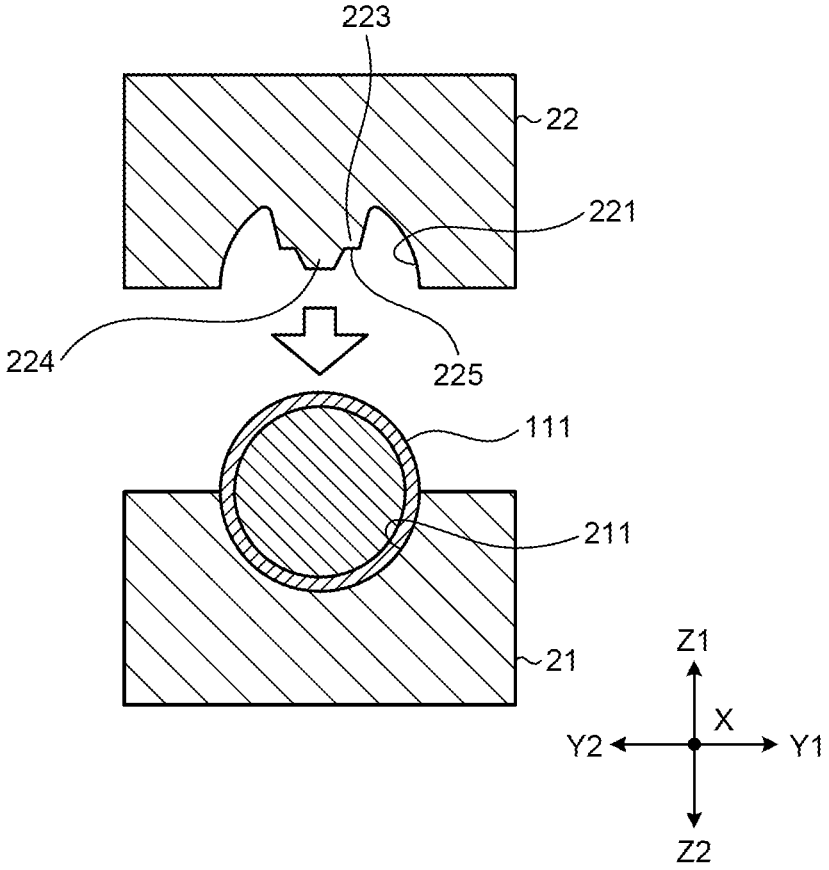
FIG. 6 is a cross-sectional schematic view illustrating that the aluminum electric wire and the crimping terminal according to the first embodiment are connected by the crimping device seen from B-B in FIG. 4.
Figure 7:
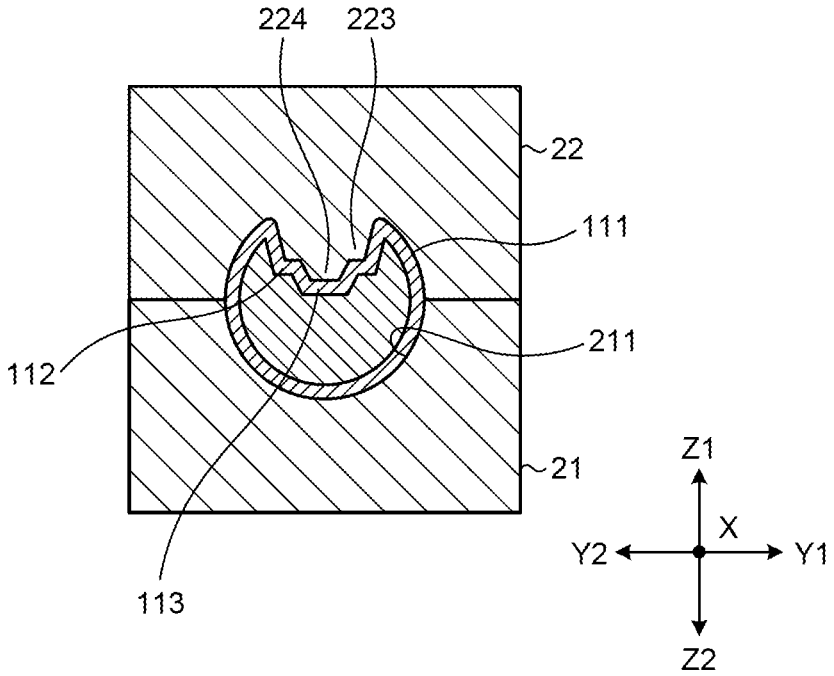
FIG. 7 is a cross-sectional schematic view illustrating that the aluminum electric wire and the crimping terminal according to the first embodiment are connected by the crimping device seen from C-C in FIG. 5.
Figure 8:
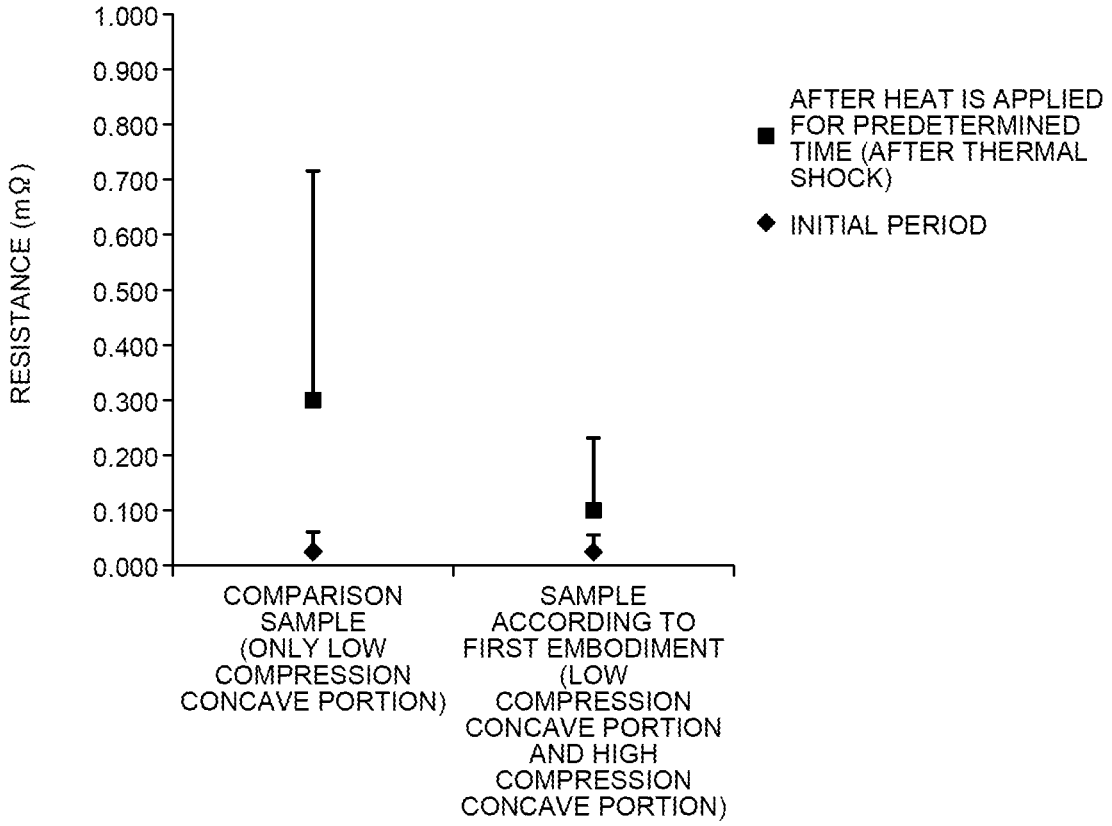
FIG. 8 is a view illustrating a resistance value of the aluminum electric wire crimping terminal according to the first embodiment.

FIGS. 1 to 8 relate to the first embodiment, and FIG. 1 is a perspective view illustrating an aluminum electric wire W and a crimping terminal 10. FIG. 2 is a perspective view of an aluminum electric wire crimping terminal 1. FIG. 3 is a cross-sectional view of the aluminum electric wire crimping terminal 1 seen from A-A in FIG. 2. FIG. 4 is a cross-sectional view illustrating that the aluminum electric wire W and the crimping terminal 10 are connected by a crimping device 2. FIG. 5 is a cross-sectional view illustrating that the aluminum electric wire W and the crimping terminal 10 are connected by the crimping device 2. FIG. 6 is a cross-sectional schematic view illustrating that the aluminum electric wire W and the crimping terminal 10 are connected by the crimping device 2 seen from B-B in FIG. 4. FIG. 7 is a cross-sectional schematic view illustrating that the aluminum electric wire W and the crimping terminal 10 are connected by the crimping device 2 seen from C-C in FIG. 5. FIG. 8 is a view illustrating a resistance value of the aluminum electric wire crimping terminal 1. In addition, FIG. 1 illustrates a state before the aluminum electric wire W and the crimping terminal 10 are connected, and FIGS. 6 and 7 schematically illustrate core wires W1. In this regard, the aluminum electric wire crimping terminal 1 is formed by connecting the aluminum electric wire W and the crimping terminal 10.

As illustrated in FIG. 1, the aluminum electric wire W includes a plurality of core wires W1 which is molded as conductors by an aluminum or an aluminum alloy which is a conductive metal material, and a sheath W2 which covers a plurality of core wires W1 and is molded by an insulation resin material.

The crimping terminal 10 is connected with the aluminum electric wire W, and includes a contact portion 12 on a side in the forward direction X1 and a crimping portion 11 of a cylindrical shape on a side in the backward direction X2 in the forward and backward directions X. The crimping terminal 10 is formed by a conductive metal material such as a copper or a copper alloy, and is applied tinning or chrome plating. An insertion hole 111 which penetrates in the forward and backward directions X is formed in the crimping portion 11 of the cylindrical shape, and a plurality of core wires W1 of the aluminum electric wire W is inserted in the insertion hole 111. The contact portion 12 includes a through-hole 121 which penetrates in the height direction Z. The contact portion 12 is mechanically and electrically connected with a connected body when the crimping terminal 10 is overlaid on the unillustrated connected body in the height direction Z and an unillustrated bolt is inserted and fastened in the through-hole 121.

The aluminum electric wire crimping terminal 1 is formed by connecting the aluminum electric wire W and the crimping terminal 10 as illustrated in FIGS. 2 and 3. In the crimping portion 11 of the crimping terminal 10 of the aluminum electric wire crimping terminal 1, a low compression concave portion 112 and a high compression concave portion 113 are formed. The high compression concave portion 113 further protrudes in the lower direction Z2 more than a distal end surface 112A of the low compression concave portion 112. The high compression concave portion 113 according to the present embodiment is formed at a substantially center of the low compression concave portion 112 in the forward and backward directions X and the width direction Y.

When the sheath W2 of the aluminum electric wire W is peeled in the insertion hole 111 of the crimping portion 11 of the crimping terminal 10, a plurality of core wires W1 which is partially exposed to the outside is inserted facing the forward direction X1, and a low compression convex portion 223 and a high compression convex portion 224 of the crimping device 2 described below compress the crimping portion 11 and a plurality of core wires W1, a plurality of core wires W1 and the crimping portion 11 are connected. The crimping device 2 described below molds in the crimping portion 11 the low compression concave portion 112 and the high compression concave portion 113 which protrude in the lower direction Z2 and compress a plurality of core wires W1. The low compression concave portion 112 is formed when the low compression convex portion 223 described below dents part of the crimping portion 11 of the cylindrical shape toward the lower direction Z2. The high compression concave portion 113 is formed when the high compression convex portion 224 described below further dents part of the distal end surface 112A of the low compression concave portion 112 toward the lower direction Z2. In addition, when being molded protruding toward the lower direction Z2, the high compression concave portion 113 is set to protrude at such a protrusion height that a plurality of core wires W1 is not cut, i.e., damaged.

In this regard, mechanical connection of the aluminum electric wire crimping terminal 1 is made mainly by the low compression concave portion 112. When a force in a direction in which the aluminum electric wire W and the crimping terminal 10 move away from each other is applied in the forward and backward directions X, a compression force of the low compression concave portion 112 which compresses a plurality of core wires W1 prevents the aluminum electric wire W and the crimping terminal 10 from moving apart from each other. Hence, a retaining force (adhesion force) of mechanical connection of the aluminum electric wire crimping terminal 1 is secured by the low compression concave portion 112.

Electrical connection of the aluminum electric wire crimping terminal 1 is made mainly by the high compression concave portion 113. The high compression concave portion 113 further protrudes in the lower direction Z2 more than a distal end surface 112A of the low compression concave portion 112. The high compression concave portion 113 compresses a plurality of core wires W1 with a stronger compression force than the compression force of the low compression concave portion 112, i.e., a stronger compression force than the compression force of the low compression concave portion 112. Therefore, an oxide film interposed between the neighboring core wires W1 and an oxide film interposed between the core wire W1 and an inner circumferential surface of the crimping portion 11 are broken. Furthermore, metals adhere to each other at a contact portion of the neighboring core wires W1, and metals adhere to each other at a contact portion of the core wires W1 and the inner circumferential surface of the crimping portion 11. Reliability of electrical connection of the aluminum electric wire crimping terminal 1 is secured since the high compression concave portion 113 breaks the oxide film and the metals adhere to each other, so that the resistance becomes low and the reliability of electrical connection improves.

Next, the crimping device 2 which manufactures the aluminum electric wire crimping terminal 1 will be described. As illustrated in FIGS. 4 to 7, the crimping device 2 includes a lower mold (anvil) 21 and an upper mold (crimper) 22. The lower mold 21 and the upper mold 22 are placed close to each other in the height direction Z by an unillustrated driving unit, compress the crimping portion 11 of the crimping terminal 10 and move away from each other after the compression.

The lower mold 21 includes a mounting concave portion 211 located on the side in the upper direction Z1. The mounting concave portion 211 is cut out so as to dent in the lower direction Z2 more than the upper surface in the upper direction Z1 of the lower mold 21, is partitioned by a semicylindrical molding surface, and is formed in a semicylindrical shape. The mounting concave portion 211 regulates the position of the crimping portion 11 such that the crimping portion 11 is not displaced in the width direction Y in a state where the crimping portion 11 of the cylindrical shape is set.

The upper mold 22 includes a concave portion 221 located on the side in the lower direction Z2. The concave portion 221 is cut out so as to dent in the upper direction Z1 more than the lower surface in the lower direction Z2 of the upper mold 22, is partitioned by a semicylindrical molding surface, and is formed in a semicylindrical shape. The low compression convex portion 223 and the high compression convex portion 224 which protrude in the lower direction Z2 are integrally molded in the concave portion 221. The low compression convex portion 223 and the high compression convex portion 224 protrude in the lower direction Z2 more than the semicylindrical molding surface. The low compression convex portion 223 molds the low compression concave portion 112 in the crimping portion 11 of the crimping terminal 10. The high compression convex portion 224 molds the high compression concave portion 113 in the crimping portion 11 of the crimping terminal 10. The low compression convex portion 223 is formed in a shape formed by cutting a distal end side of a quadrangular pyramid on a plane parallel to a bottom surface, and is formed in a trapezoidal shape in a cross-sectional view in the width direction Y and a cross-sectional view in the forward and backward directions X and is tapered toward the lower direction Z2 as illustrated in FIGS. 4 and 6. The high compression convex portion 224 is formed further protruding in the lower direction more than a flat surface 225 of the low compression convex portion 223. The high compression convex portion 224 is formed in a shape formed by cutting a distal end side of a quadrangular pyramid on a plane parallel to a bottom surface, and is formed in a trapezoidal shape in the cross-sectional view in the width direction Y and the cross-sectional view in the forward and backward directions X and is tapered toward the lower direction Z2. In addition, the high compression convex portion 224 according to the present embodiment is formed at a substantially center of the low compression convex portion 223 in the forward and backward directions X and the width direction Y. Furthermore, the low compression convex portion 223 and the high compression convex portion 224 are each molded protruding so as to be tapered toward the lower direction Z2 to make the low compression convex portion 223 and the high compression convex portion 224 easily detach from the low compression concave portion 112 and the high compression concave portion 113 molded when the crimping portion 11 is compressed in a case where the lower mold 21 and the upper mold 22 move away from each other in the height direction Z.

Next, a crimping method of the aluminum electric wire crimping terminal 1 will be described. As illustrated in FIGS. 4 to 7, the crimping method first inserts a plurality of core wires W1 of the aluminum electric wire W in the insertion hole 111 of the crimping portion 11 of the crimping terminal 10. Next, the crimping portion 11 is placed on the mounting concave portion 211 of the lower mold 21 of the crimping device 2. In this case, a plurality of core wires W1 maintains a state where the plurality of core wires W1 is inserted in the insertion hole 111 of the crimping portion 11. Next, an unillustrated driving mechanism provided in the crimping device 2 lowers the upper mold 22 toward the lower mold 21 located in the lower direction Z2. In this case, the high compression convex portion 224 of the upper mold 22 first compresses the crimping portion 11 and the core wires W1 and molds the high compression concave portion 113, and then the low compression convex portion 223 compresses the crimping portion 11 and the core wires W1 and molds the low compression concave portion 112. Furthermore, when the upper surface on the side in the upper direction Z1 of the lower mold 21 and the lower surface on the side in the lower direction Z2 of the upper mold 22 come into contact, the compression is finished, and connection of the aluminum electric wire W and the crimping terminal 10 is finished. Next, the unillustrated driving mechanism provided to the crimping device 2 lifts the upper mold 22 toward the upper direction Z1 and detaches the aluminum electric wire crimping terminal 1 from the lower mold 21. According to the above process, the aluminum electric wire crimping terminal 1 is manufactured by the crimping device 2.

According to the aluminum electric wire crimping terminal 1 according to the present embodiment, in a state where a plurality of core wires W1 is inserted in the insertion hole 111, the crimping portion 11 is compressed and a plurality of core wires W1 and the crimping portion 11 are connected, the low compression concave portion 112 which compresses a plurality of core wires W1 and the high compression concave portion 113 which compresses a plurality of core wires W1 are molded in the crimping portion 11. The high compression concave portion 113 further protrudes in the lower direction Z2 more than the distal end surface 112A of the low compression concave portion 112, and compresses a plurality of core wires W1 with the stronger compression force than the compression force of the low compression concave portion 112, i.e., a stronger compression force than the compression force of the low compression concave portion 112. Consequently, the high compression concave portion 113 compresses a plurality of core wires W1 with the stronger compression force than the compression force of the low compression concave portion 112. The oxide film interposed between the neighboring core wires W1 and the oxide film interposed between the core wire W1 and the inner circumferential surface of the crimping portion 11 are broken. Furthermore, metals adhere to each other at a contact portion of the neighboring core wires W1, and metals adhere to each other at a contact portion of the core wires W1 and the inner circumferential surface of the crimping portion 11. Consequently, reliability of electrical connection of the aluminum electric wire crimping terminal 1 is secured since the high compression concave portion 113 breaks the oxide film and the metals adhere to each other, and improves since the resistance becomes low.

Hereinafter, a result obtained by measuring the resistance of the aluminum electric wire crimping terminal 1 will be described. In FIG. 8, a left side illustrates a resistance value of a comparison sample obtained from a plurality of samples, and a right side illustrates a resistance value according to the first embodiment obtained from a plurality of samples. The comparison sample is an aluminum electric wire crimping terminal formed by connecting the aluminum electric wire W of a predetermined length with the crimping terminal in which only the low compression concave portion 112 is molded. The sample according to the first embodiment is the aluminum electric wire crimping terminal 1 formed by connecting the aluminum electric wire W of a predetermined length with the crimping terminal 10 in which the low compression concave portion 112 and the high compression concave portion 113 are molded.

As illustrated in FIG. 8, initial resistance values of the comparison sample and the sample according to the first embodiment are lower than 0.100 (mΩ), and the resistance value of the sample according to the first embodiment is lower. On the other hand, as for the resistance values after heat of the same predetermined value is applied to the comparison sample and the sample according to the first embodiment for the same predetermined time (after a thermal shock), the comparison sample is approximately 0.300 (mΩ) to a little over 0.700 (mΩ) and the sample according to the first embodiment is approximately 0.300 (mΩ) to a little over 0.200 (mΩ). That is, the sample according to the first embodiment has the smaller resistance value at an initial period and after the thermal shock, and the resistance value after the thermal shock in particular is small. Consequently, by molding the high compression concave portion 113, it is possible to improve reliability of electrical connection.

Furthermore, according to the crimping device 2 according to the present embodiment, when the upper mold 22 lowers toward the lower mold 21 located in the lower direction Z2 in a state where a plurality of core wires W1 is inserted in the insertion hole 111, the low compression convex portion 223 compresses the crimping portion 11 and a plurality of core wires W1, the high compression convex portion 224 more strongly compresses the crimping portion 11 and a plurality of core wires W1, and the low compression concave portion 112 and the high compression concave portion 113 are molded in the crimping portion 11. Consequently, reliability of electrical connection of the aluminum electric wire crimping terminal 1 manufactured by the crimping device 2 is secured since the high compression concave portion 113 breaks the oxide film and the metals adhere to each other, so that the resistance becomes low and the reliability of electrical connection improves.

According to the crimping method according to the first embodiment, in a process of lowering the upper mold 22 in the lower direction Z2, the low compression convex portion 223 compresses the crimping portion 11 and a plurality of core wires W1, the high compression convex portion 224 more strongly compresses the crimping portion 11 and a plurality of core wires W1, and the low compression concave portion 112 and the high compression concave portion 113 are molded in the crimping portion 11. Consequently, according to the crimping method according to the first embodiment, reliability of electrical connection of the aluminum electric wire crimping terminal 1 formed by connecting the aluminum electric wire W and the crimping terminal 10 is secured since the high compression concave portion 113 breaks the oxide film and the metals adhere to each other, so that the resistance becomes low and the reliability of electrical connection improves.

Second Embodiment

Figure 9:
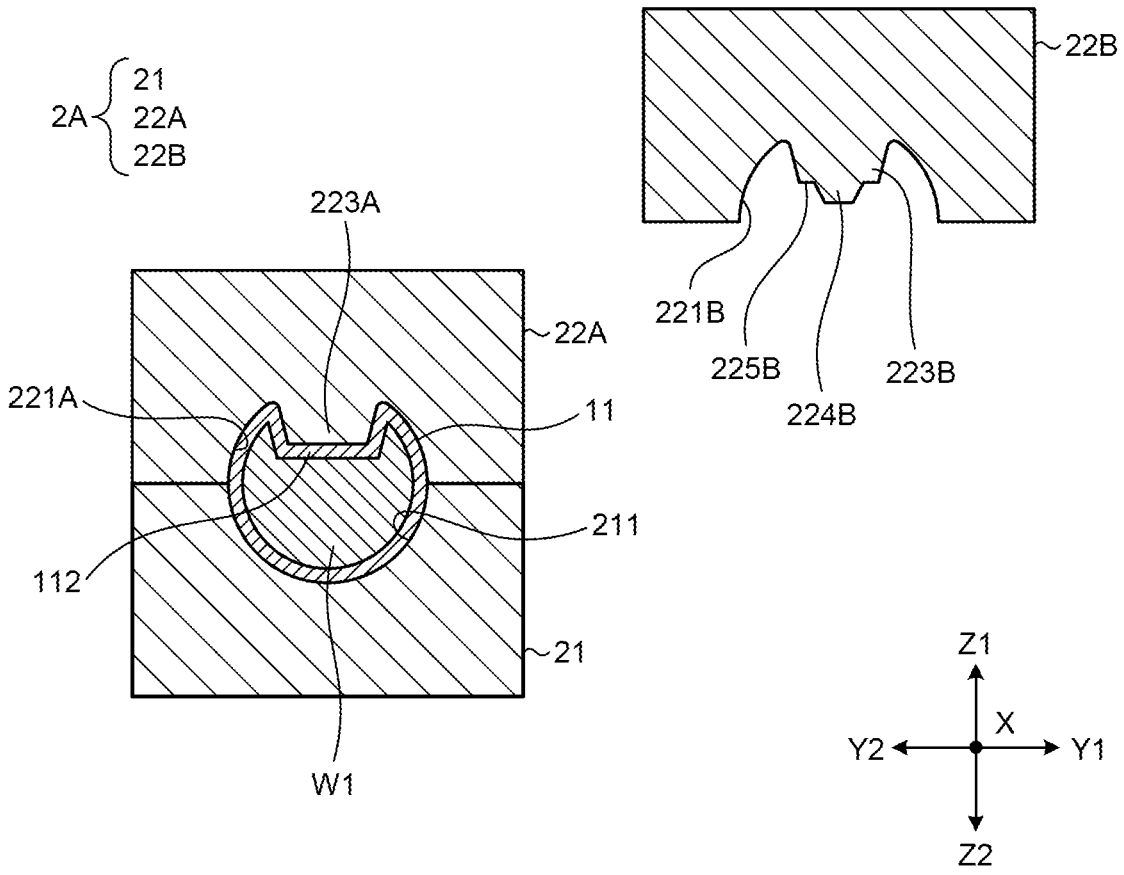
FIG. 9 is a cross-sectional schematic view illustrating that an aluminum electric wire and a crimping terminal according to a second embodiment are connected by a crimping device.
Figure 10:
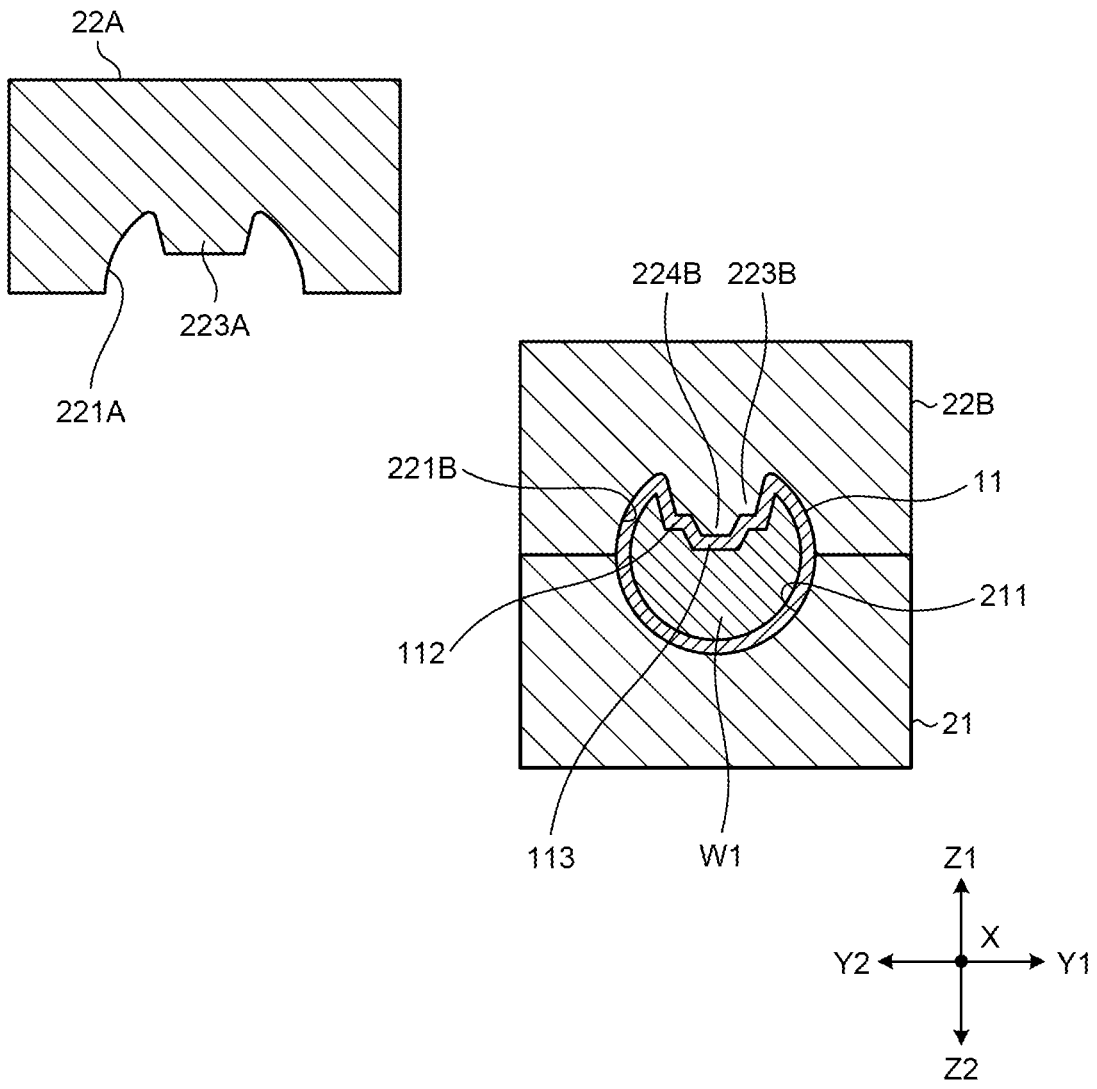
FIG. 10 is a cross-sectional schematic view illustrating that the aluminum electric wire and the crimping terminal according to the second embodiment are connected by the crimping device.

Next, a crimping device and a crimping method which manufacture an aluminum electric wire crimping terminal according to the second embodiment will be described. FIG. 9 is a cross-sectional schematic view illustrating that the aluminum electric wire and the crimping terminal according to the second embodiment are connected by the crimping device. FIG. 10 is a cross-sectional schematic view illustrating that the aluminum electric wire and the crimping terminal according to the second embodiment are connected by the crimping device. FIGS. 9 and 10 schematically illustrate a core wire W1. In addition, the same portions as those in the first embodiment will be assigned the same reference numerals, and will not be described in detail in the second embodiment.

A crimping device 2A which manufactures an aluminum electric wire crimping terminal 1 includes a lower mold 21, a first upper mold 22A and a second upper mold 22B as illustrated in FIGS. 9 and 10. The lower mold 21, the first upper mold 22A and the second upper mold 22B compress a crimping portion 11 of a crimping terminal 10 in a height direction Z when an unillustrated driving unit places the lower mold 21 and the first upper mold close to each other, and then more strongly compress the crimping portion 11 of the crimping terminal 10 when the lower mold 21 and the second upper mold come close to each other.

The lower mold 21 includes a mounting concave portion 211 located on the side in an upper direction Z1. The mounting concave portion 211 is cut out so as to dent in a lower direction Z2 more than the upper surface in the upper direction Z1 of the lower mold 21, is partitioned by a semicylindrical molding surface, and is formed in a semicylindrical shape.

The first upper mold 22A includes a concave portion 221A located on the side in the lower direction Z2. The concave portion 221A is cut out so as to dent in the upper direction Z1 more than the lower surface in the lower direction Z2 of the first upper mold 22A, is partitioned by a semicylindrical molding surface, and is formed in a semicylindrical shape. A low compression convex portion 223A which protrudes in the lower direction Z2 is integrally molded in the concave portion 221A. The low compression convex portion 223A protrudes in the lower direction Z2 more than the semicylindrical molding surface. The low compression convex portion 223A molds a low compression concave portion 112 in the crimping portion 11 of the crimping terminal 10. The low compression convex portion 223A is formed in a shape formed by cutting a distal end side of a quadrangular pyramid on a plane parallel to a bottom surface, and is formed in a trapezoidal shape in the cross-sectional view in a width direction Y and the cross-sectional view in forward and backward directions X and is tapered toward the lower direction Z2.

The second upper mold 22B includes a concave portion 221B of a semicylindrical shape located on a side in the lower direction Z2. The concave portion 221B is cut out so as to dent in the upper direction Z1 more than the lower surface in the lower direction Z2 of the second upper mold 22B, is partitioned by a semicylindrical molding surface, and is formed in a semicylindrical shape. A low compression convex portion 223B and a high compression convex portion 224B which protrude in the lower direction Z2 are integrally molded in the concave portion 221B. The low compression convex portion 223B and the high compression convex portion 224B protrude in the lower direction Z2 more than the semicylindrical molding surface. The high compression convex portion 224B molds a high compression concave portion 113 in the crimping portion 11 of the crimping terminal 10. The convex portion 223B is formed in a shape formed by cutting a distal end side of a quadrangular pyramid on a plane parallel to a bottom surface, and is formed in a trapezoidal shape in the cross-sectional view in the width direction Y and the cross-sectional view in the forward and backward directions X and is tapered toward the lower direction Z2. The high compression convex portion 224B is formed further protruding in the lower direction more than a flat surface 225B of the convex portion 223B. The high compression convex portion 224B is formed in a shape formed by cutting a distal end side of a quadrangular pyramid on a plane parallel to a bottom surface, and is formed in a trapezoidal shape in the cross-sectional view in the width direction Y and the cross-sectional view in the forward and backward directions X and is tapered toward the lower direction Z2. Furthermore, the convex portion 223B according to the present embodiment may have the same dimension and the same shape as or a smaller dimension than and a different shape from those of the low compression convex portion 223A of the first upper mold 22A.

Next, a crimping method of the aluminum electric wire crimping terminal 1 will be described. As illustrated in FIGS. 9 and 10, the crimping method first inserts a plurality of core wires W1 of an aluminum electric wire W in an insertion hole 111 of the crimping portion 11 of the crimping terminal 10. Next, the crimping portion 11 is placed on the mounting concave portion 211 of the lower mold 21 of the crimping device 2A. In this case, a plurality of core wires W1 maintains a state where the plurality of core wires W1 is inserted in the insertion hole 111 of the crimping portion 11. Next, in a state where an unillustrated driving mechanism provided to the crimping device 2A makes the first upper mold 22 and the lower mold 21 face in the height direction Z, the first upper mold 22A is lowered toward the lower mold 21 located in the lower direction Z2. In this case, the low compression convex portion 223A of the first upper mold 22A compresses the crimping portion 11 and the core wires W1, and molds the low compression concave portion 112 in the crimping portion 11. Thus, the upper surface on the side in the upper direction Z1 of the lower mold 21 and the lower surface on the side in the lower direction Z2 of the first upper mold 22A come into contact, so that primary compression is finished. Next, in a state where the unillustrated driving mechanism provided to the crimping device 2A lifts the first upper mold 22A toward the upper direction Z1 in the height direction Z, and makes the second upper mold 22B and the lower mold 21 face each other, the second upper mold 22B is lowered toward the lower mold 21 located in the lower direction Z2. In this case, the high compression convex portion 224B of the second upper mold 22B more strongly compresses part of the low compression concave portion 112 and the core wires W1, and molds the high compression concave portion 113 in the low compression concave portion 112. Consequently, when the upper surface on the side in the upper direction Z1 of the lower mold 21 and the lower surface on the side in the lower direction Z2 of the second upper mold 22B come into contact, the secondary compression is finished, and connection of the aluminum electric wire W and the crimping terminal 10 is finished. Next, the unillustrated driving mechanism provided to the crimping device 2A lifts the second upper mold 22B toward the upper direction Z1 and detaches the aluminum electric wire crimping terminal 1 from the lower mold 21. According to the above process, the aluminum electric wire crimping terminal 1 is manufactured.

According to the crimping device 2A according to the present embodiment, when the first upper mold 22A lowers in the lower direction Z2 facing the lower mold 21 in a state where a plurality of core wires W1 is inserted in the insertion hole 111, the low compression convex portion 223A compresses the crimping portion 11 and a plurality of core wires W1, and the low compression concave portion 112 is molded in the crimping portion 11. Subsequently, the second upper mold 22B lowers in the lower direction Z2 facing the lower mold 21, the high compression convex portion 224B more strongly compresses the crimping portion 11 which is compressed by the low compression convex portion 223A, and part of a plurality of core wires W1, and the high compression concave portion 113 is molded in the crimping portion 11. Consequently, reliability of electrical connection of the aluminum electric wire crimping terminal 1 manufactured by the crimping device 2 is secured since the high compression concave portion 113 breaks the oxide film and the metals adhere to each other, so that the resistance becomes low and the reliability of electrical connection improves. Furthermore, the crimping device 2A according to the present embodiment includes the separate upper molds such that the low compression convex portion 223A of the first upper mold 22A compresses the crimping portion 11 and a plurality of core wires W1, then the high compression convex portion 224B of the second upper mold 22B compresses the crimping portion 11 and a plurality of core wires W1, and molds the low compression concave portion 112 and the high compression concave portion 113 in two processes, so that it is possible to prevent damages such as cutting of the core wires W1 when manufacturing the aluminum electric wire crimping terminal 1.

According to the crimping method according to the present embodiment, in a process of lowering the first upper mold 22A in the lower direction Z2, the low compression convex portion 223A of the first upper mold 22A compresses the crimping portion 11 and a plurality of core wires W1, and molds the low compression concave portion 112 in the crimping portion 11. Subsequently, in a process of lowering the second upper mold 22B in the lower direction Z2, the high compression convex portion 224B of the second upper mold 22B more strongly compresses part of the low compression concave portion 112 and the core wires W1, and molds the high compression concave portion 113 in the low compression concave portion 112. Consequently, reliability of electrical connection of the aluminum electric wire crimping terminal 1 manufactured by the crimping device 2 is secured since the high compression concave portion 113 breaks the oxide film and the metals adhere to each other, so that the resistance becomes low and the reliability of electrical connection improves. Furthermore, the crimping method according to the present embodiment separates processes such that the low compression convex portion 223A of the first upper mold 22A compresses the crimping portion 11 and a plurality of core wires W1, then the high compression convex portion 224B of the second upper mold 22B compresses the crimping portion 11 and a plurality of core wires W1, and molds the low compression concave portion 112 and the high compression concave portion 113 in two processes, so that it is possible to prevent damages such as cutting of the core wires W1 when manufacturing the aluminum electric wire crimping terminal 1.

Figure 11:
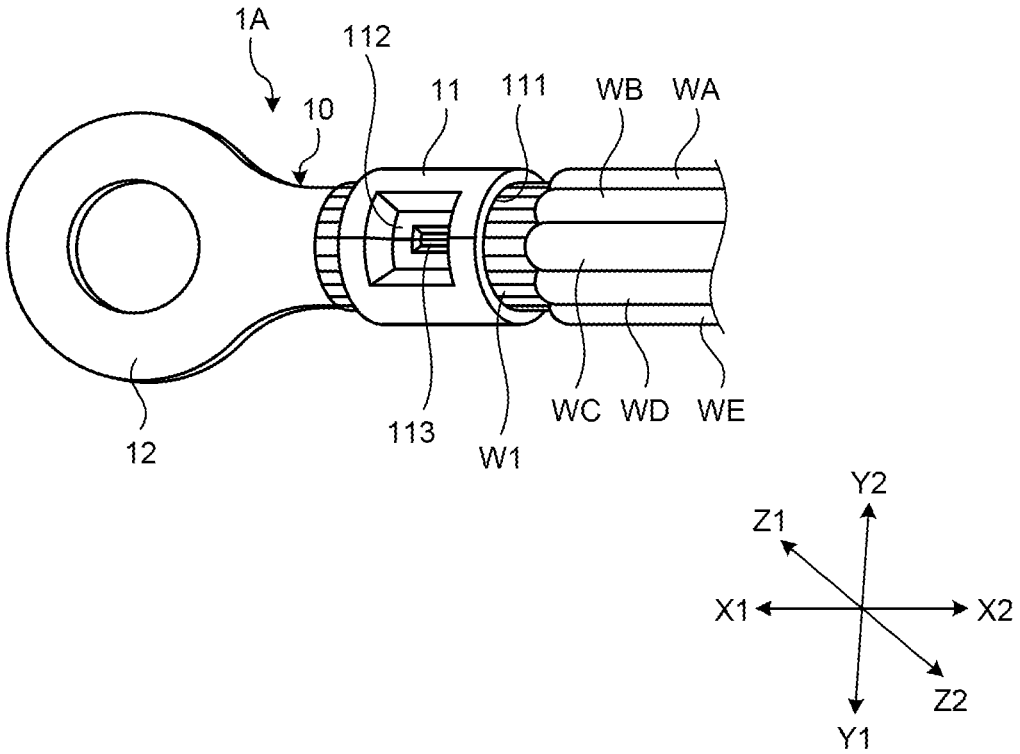
FIG. 11 is a perspective view of an aluminum electric wire crimping terminal formed by connecting a plurality of aluminum electric wires and a crimping terminal according to a modified example.

In addition, the aluminum electric wire crimping terminal 1 according to the above method connects the one crimping terminal 10 and the one aluminum electric wire W, yet is not limited to this. FIG. 11 is a perspective view of an aluminum electric wire crimping terminal formed by connecting a plurality of aluminum electric wires and a crimping terminal according to a modified example. As illustrated in FIG. 11, the crimping terminal 10 may be connected with a plurality of aluminum electric wires WA, WB, WC, WD, WE and . . . . In a state where a plurality of aluminum electric wires WA, WB, WC, WD, WE and . . . is bundled, each core wire W1 is inserted in the insertion hole 111 of the crimping portion 11 of the crimping terminal 10, and a crimping device 2 or the crimping device 2A compresses the crimping portion 11, so that the one crimping terminal 10 and a plurality of aluminum electric wires WA, WB, WC, WD, WE and . . . are connected and, consequently, it is possible to form a joint circuit in terms of an electric circuit.

Figure 12:
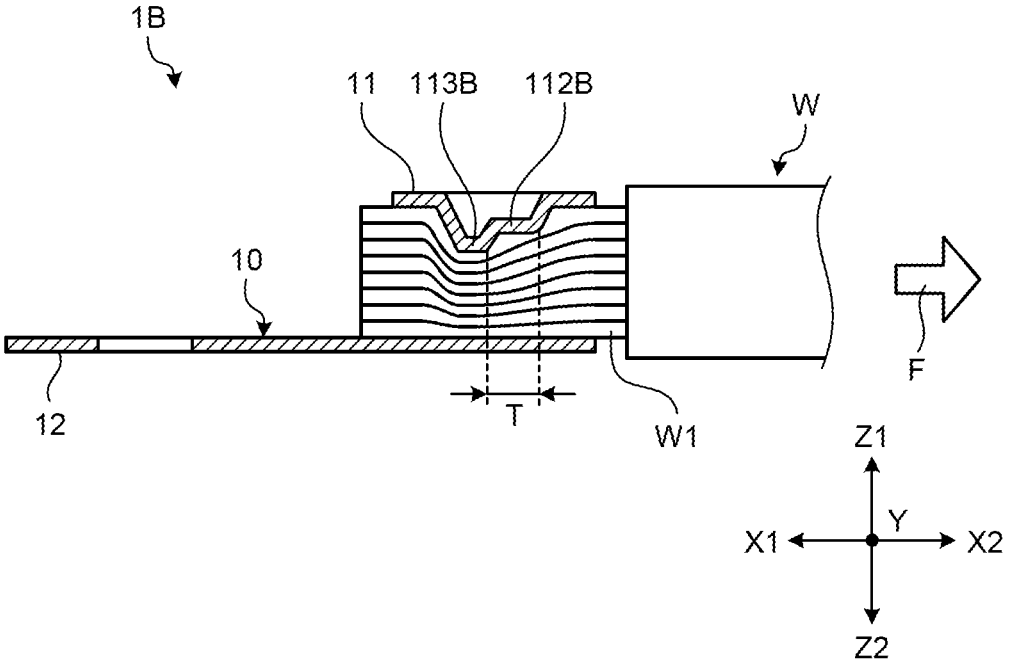
FIG. 12 is a cross-sectional view illustrating the aluminum electric wire crimping terminal according to the modified example.

Furthermore, according to the aluminum electric wire crimping terminal 1 according to the above embodiment, a molding position of the high compression concave portion 113 with respect to the low compression concave portion 112 is at a substantially center in the forward and backward directions, yet is not limited to this. FIG. 12 is a cross-sectional view of the aluminum electric wire crimping terminal according to the modified example. A high compression concave portion 113B of an aluminum electric wire crimping terminal 1B may be molded on a side in a forward direction X1 which is a side of a contact portion 12 of a low compression concave portion 112B in the forward and backward directions X. In the forward and backward directions X and on a backward direction X2 of the high compression concave portion 113B, the low compression concave portion 112B compresses a plurality of core wires W1 at a wider width T. Hence, even when the aluminum electric wire W applies a stronger tensile force F, this force is absorbed by a plurality of core wires W1 compressed by the low compression concave portion 112B at the wider width T, so that it is possible to reduce the force to be applied to the core wires W1 compressed by the high compression concave portion 113B and consequently prevent a damage on the core wires W1. In addition, in this case, a high compression convex portion 224 of the upper mold 22 is molded on the side in the forward direction X1 with respect to a low compression convex portion 223, and the high compression convex portion 224B of the second upper mold 22B is molded on the side in the forward direction X1 with respect to the convex portion 223B.

Furthermore, the crimping portion 11 of the above aluminum electric wire crimping terminal 1 has the cylindrical shape yet may have a square tubular shape.

The crimping device 2A according to the above second embodiment includes the two upper molds, molds the low compression convex portion 223A in the first upper mold 22A, molds the high compression convex portion 224B in the second upper mold 22B, and compresses the crimping portion 11 and a plurality of core wires W1 in the two processes. However, by molding the low compression convex portion 223A in one upper mold, assembling a slide mold in an upper mold and making one end side of the slide mold protrude from the low compression convex portion 223A, the one end side of the slide mold may be caused to function as the high compression convex portion 224A and the one upper mold may compress the crimping portion 11 and a plurality of core wires W1 in the two processes.

There is an effect that an aluminum electric wire crimping terminal formed by connecting an aluminum electric wire and a crimping terminal according to the present embodiment improves reliability of electrical connection, and a crimping device and a crimping method manufactures the aluminum electric wire crimping terminal having improved reliability of electrical connection.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An aluminum electric wire crimping terminal comprising:

an aluminum electric wire extending in a forward direction; and a crimping terminal that is connected with the aluminum electric wire, wherein the aluminum electric wire includes a plurality of core wires, and a sheath that covers the plurality of core wires, the crimping terminal includes a contact portion and a crimping portion of a cylindrical shape, the crimping portion includes an insertion hole, and in a state where the plurality of core wires is inserted in the insertion hole, the crimping portion is compressed and the plurality of core wires and the crimping portion directly contact each other and are directly electrically connected to each other, a low compression concave portion that has a concave shape recessed on the side of the plurality of a core wires from the crimping portion and that compresses and electrically contacts the plurality of core wires and a high compression concave portion that has a concave shape recessed on the side of the plurality of core wires from the crimping portion and that compresses and electrically contacts the plurality of core wires are molded in the crimping portion and offset from each other in the forward direction, and the high compression concave portion further protrudes in a lower direction more than a distal end surface of the low compression concave portion, and compresses the plurality of core wires with a stronger compression force than a compression force of the low compression concave portion.

2. The aluminum electric wire crimping terminal according to claim 1, wherein the high compression concave portion is located and molded on a side in the forward direction of the low compression concave portion.

* * * * *